US011464695B2

(12) United States Patent
Kong

(10) Patent No.: US 11,464,695 B2
(45) Date of Patent: Oct. 11, 2022

(54) STANDING AND WALKING SUPPORT DEVICE, SYSTEM AND METHOD OF USE

(71) Applicant: Dersing Kong, San Francisco, CA (US)

(72) Inventor: Dersing Kong, San Francisco, CA (US)

( * ) Notice: Subject to any disclaimer, the term of this patent is extended or adjusted under 35 U.S.C. 154(b) by 0 days.

(21) Appl. No.: 16/209,819

(22) Filed: Dec. 4, 2018

(65) Prior Publication Data

US 2020/0170860 A1 Jun. 4, 2020

(51) Int. Cl.

| | |
|---|---|
| ***A61H 3/02*** | (2006.01) |
| ***A61G 7/053*** | (2006.01) |
| ***A45B 9/02*** | (2006.01) |
| ***A61G 7/10*** | (2006.01) |
| ***A61H 3/00*** | (2006.01) |
| *A45B 9/00* | (2006.01) |

(52) U.S. Cl.

CPC ..... *A61G 7/0533* (2013.01); *A45B 9/02* (2013.01); *A61G 7/1019* (2013.01); *A61G 7/1038* (2013.01); *A61H 3/00* (2013.01); *A45B 2009/007* (2013.01)

(58) Field of Classification Search

CPC .... A61H 3/00; A61H 3/02; A61H 2201/0161; A61H 2201/0192; A61H 3/0277; A61H 2003/0283; A61H 2003/0233

USPC ..... 135/65–66, 68–70, 75, 82, 84; 248/188.5, 188.8, 354.1

See application file for complete search history.

(56) References Cited

U.S. PATENT DOCUMENTS

| | | | | | |
|---|---|---|---|---|---|
| 39,854 | A * | 9/1863 | Wemple | A61H 3/02 | 135/68 |
| 1,277,009 | A * | 8/1918 | Weldon | A61H 3/02 | 135/68 |
| 2,195,034 | A * | 3/1940 | Miller | A61H 3/02 | 135/68 |
| 2,474,722 | A * | 6/1949 | Blume | A45B 9/00 | 135/69 |
| 2,547,265 | A * | 4/1951 | Hilgeman | A61H 3/02 | 135/73 |
| 3,280,831 | A * | 10/1966 | McCall Parker | A61H 3/02 | 135/68 |
| 3,417,765 | A | 12/1968 | Slater et al. | | |
| 3,443,569 | A | 5/1969 | Ernst | | |

(Continued)

FOREIGN PATENT DOCUMENTS

| | | |
|---|---|---|
| CN | 104546385 B | 11/2017 |
| JP | 3112349 U | 8/2005 |

OTHER PUBLICATIONS

The International Search Report and Written Opinion for the International Application PCT/US2019/64285 dated Feb. 18, 2020.

(Continued)

*Primary Examiner* — Noah Chandler Hawk

(74) *Attorney, Agent, or Firm* — Haverstock & Owens, A Law Corporation

(57) ABSTRACT

A standing and walking support device and system supports and aids a user as the user moves from a sitting position to a standing position. A user is able to grasp and hold a top section of the device as the user stands up. As weight of the user and/or force is placed on the top section, the device compresses under the user's weight and/or force. The device guides the user to shift their center of gravity forward. As the user stands up, the device decompresses to return to its original height. The device and system is then usable as a support as the user walks.

21 Claims, 3 Drawing Sheets

(56) References Cited

U.S. PATENT DOCUMENTS

| | | | | |
|---|---|---|---|---|
| 4,253,479 | A * | 3/1981 | Laurent | A45B 3/00 135/69 |
| 4,838,291 | A * | 6/1989 | DiVito | A61H 3/02 135/68 |
| D425,293 | S * | 5/2000 | Maalik | D3/8 |
| 10,278,887 | B2 * | 5/2019 | Khademhosseini | A61H 3/02 |
| 2007/0006906 | A1 | 1/2007 | Coe | |
| 2012/0160286 | A1 * | 6/2012 | Ban | A45B 3/00 135/75 |
| 2012/0305040 | A1 * | 12/2012 | Senatro | A45B 9/00 135/75 |
| 2017/0319423 | A1 | 11/2017 | Khademhosseini | |

OTHER PUBLICATIONS

The International Preliminary Report and Written Opinion for the International Application PCT/US2019/064285 dated Jun. 17, 2021.

* cited by examiner

STANDING AND WALKING SUPPORT DEVICE, SYSTEM AND METHOD OF USE

FIELD OF THE INVENTION

The present invention relates to systems, devices and methods for supporting the weight of a user as the user stands and walks. More specifically, the invention relates to systems, devices and methods of assisting a user as the user moves from a sitting position to a standing position and as the user walks.

BACKGROUND OF THE INVENTION

Mobility aids such as canes and walkers enable a user to walk and move from place to place to increase the mobility and independence of the user. While such aids might enable the user to move around and support the user as they move around, it still may be difficult for the user to move from a sitting position to a standing position before walking and moving around.

SUMMARY OF THE INVENTION

The present invention is directed to a standing and walking support device and system which supports and aids a user as the user moves from a sitting position to a standing position. A user is able to grasp and hold a top section of the device as the user stands up. As weight of the user and/or force is placed on the top section, the device compresses under the user's weight and/or force. The device guides the user to shift their center of gravity forward. As the user stands up, the device decompresses to return to its original height. The device and system is then usable as a support as the user walks.

In one aspect, a support device comprises a first grasping section, a second contacting section coupled to the first grasping section and for contacting the ground and a compression section between the first grasping section and the second contacting section, wherein the compression section enables the device to compress and decompress in order to assist a user as the user stands and walks. In some embodiments, the support device comprises a pushable button which enables the device to compress. In some of these embodiments, the device is locked until the button is pushed. In some embodiments, the compression section comprises one or more of a coil spring, a hydraulic shock absorber, an elastomer shock absorber and a stretchable cord. In some embodiments, the device comprises a stabilizing base at the second contacting section. In further embodiments, the first grasping section and the second contacting section comprise u-shaped tubular members. In some embodiments, the first grasping section surrounds an exterior of the second contacting section as the device compresses.

In another aspect, a support system comprises a body comprising a top section, a bottom section coupled to the top section and a compression section between the top section and the bottom section, wherein to move from a sitting position to a standing position, a user grasps the top section and applies weight to the top section to compress the body, which guides the user to shift forward, wherein then as the user moves from a sitting position to a standing position, the body decompresses to return to an original body height.

In some embodiments, the support system comprises a pushable button which enables the device to compress. In some of these embodiments, the device is locked until the button is pushed. In some embodiments, the compression section comprises one or more of a coil spring, a hydraulic shock absorber, an elastomer shock absorber and a stretchable cord. In some embodiments, the device comprises a stabilizing base at the second contacting section. In further embodiments, the top section and the bottom section comprise u-shaped tubular members. In some embodiments, the first top section surrounds an exterior of the bottom section as the device compresses.

In a further aspect, a method of assisting a person moving from a sitting position to a standing position comprises grasping a top section of a body of a supporting device and applying weight to the top section to compress the body, wherein then as the person moves from a sitting position to a standing position, the body decompresses to return to an original body height. In some embodiments, the method comprises pushing a button which enables the body to compress. In some of these embodiments, the body is locked until the button is pushed. In some embodiments, the body compresses by one or more of a coil spring, a hydraulic shock absorber, an elastomer shock absorber and a stretchable cord. In further embodiments, the method comprises using the supporting device as a walking support after standing.

In still a further aspect, a support device comprises a first tubular section comprising a handle for holding the support device, a second tubular section coupled to the first tubular section and for contacting the ground and a compression section between the first tubular section and the second tubular section, wherein the compression section enables the device to compress and decompress in order to assist a user as the user stands and walks. In some embodiments, the first tubular section surrounds an exterior of the second tubular section as the device compresses.

In another aspect, a support device comprises a top section comprising a first u-shaped tubular member, a bottom section comprising a second u-shaped tubular member coupled to the first u-shaped tubular member, wherein the top section and the bottom section form an oval-like body and a compression section between the first u-shaped tubular member and the second u-shaped tubular member, wherein the compression section enables the device to compress and decompress in order to assist a user as the user stands and walks. In some embodiments, the first u-shaped tubular member surrounds an exterior of the second u-shaped tubular member as the device compresses.

DETAILED DESCRIPTION OF THE EMBODIMENTS

Embodiments of the present application are directed to a standing and walking support device and system which supports and aids a user as the user moves from a sitting position to a standing position. A user is able to grasp and hold a top section of the device as the user stands up. As weight of the user and/or force is placed on the top section, the device compresses under the user's weight and/or force. The device guides the user to shift their center of gravity forward. As the user stands up, the device decompresses to return to its original height. The device and system is then usable as a support as the user walks.

Reference will now be made in detail to implementations of a standing and walking support device and system as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
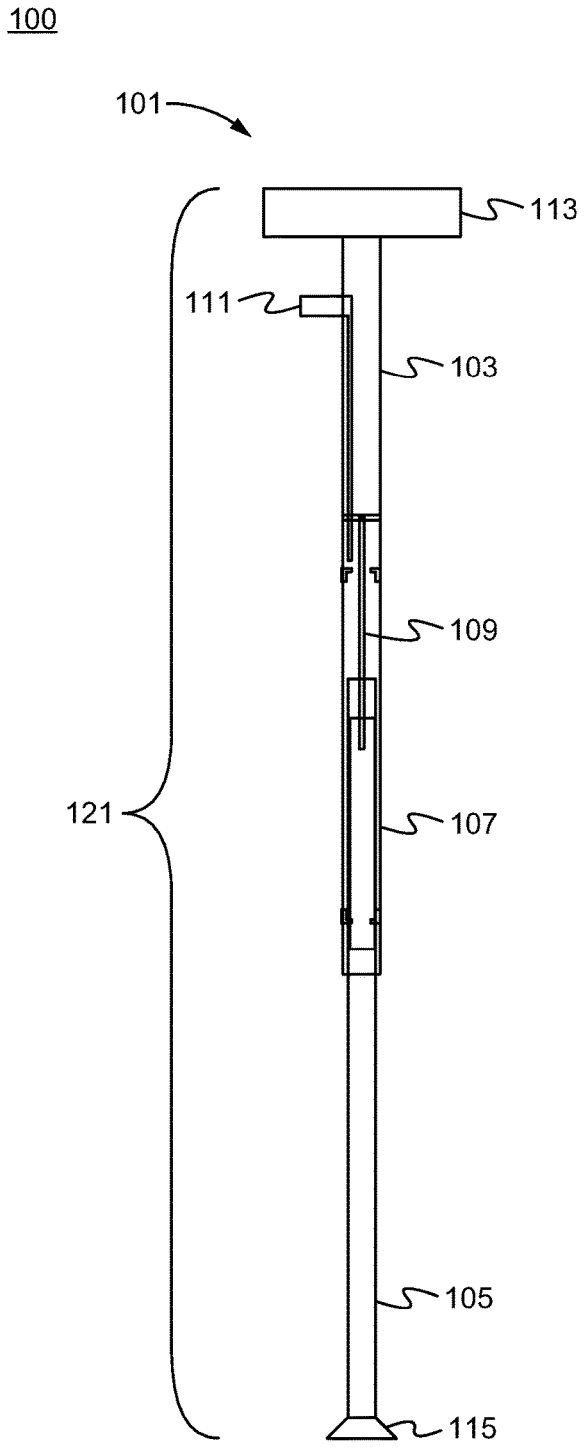
FIGS. 1A and 1B illustrate a support device and system, in accordance with some embodiments.
Figure 1B:
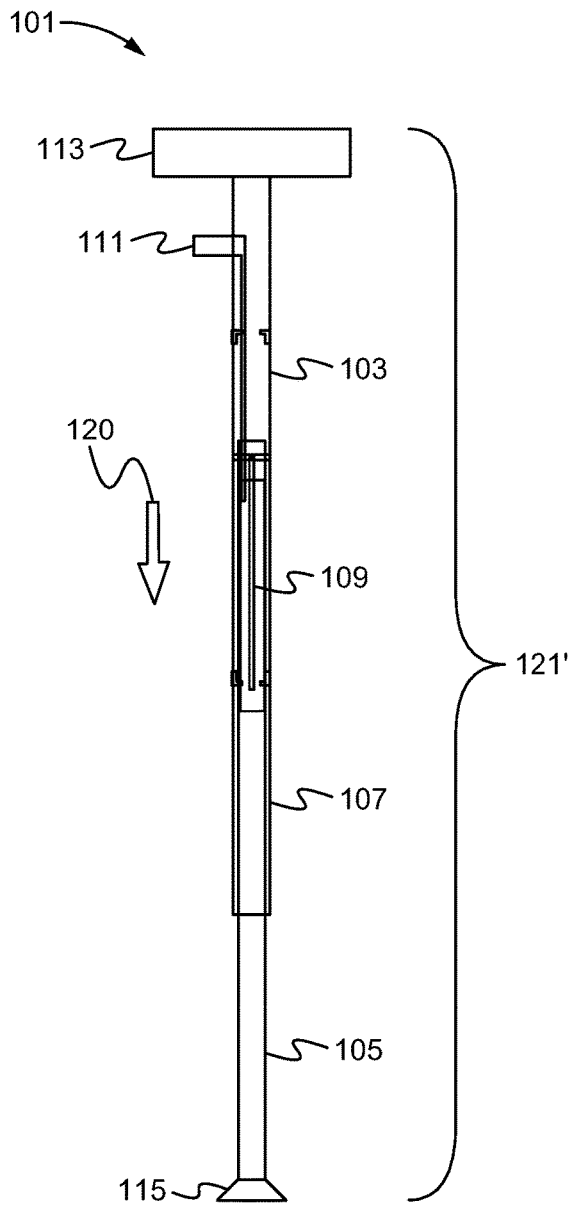

Referring now to FIG. 1A and FIG. 1B, a support device and system is depicted therein. The support device and system 100 supports a user as the user moves from a sitting position to a standing position and is also usable as a support as the user walks. As shown within FIGS. 1A and 1B, the supporting device and system 100 comprises a body 101 comprising a first grasping section 103 a second contacting section 105 for contacting the ground as the support device and system 100 is used. A compression section 107 between the first grasping section 103 and the second contacting section 105 enables the device and system 100 to compress and decompress as the user stands and walks. In some embodiments, the compression section 107 comprises one or more of a coil spring, a hydraulic shock absorber, an elastomer shock absorber and a stretchable cord within an interior 109 of the compression section 107. In some embodiments, the stretchable cord comprises a bungee cord. Particularly, the compression section 107 is able to comprise any appropriately desired compression mechanism.

As further shown within FIG. 1A, the body 101 comprises a first uncompressed height 121. As weight is applied to the body 101, the body 101 compresses at the compression section 107 and moves to a second compressed height 121$^1$ such as shown within FIG. 1B. When moving from a sitting position to a standing position, a user is able to grasp the grasping section 103. As a user begins to stand and/or applies weight and/or force to the body 101, the body is compressed to the compressed height 121$^1$. As the user continues to move to the standing position, the body 101 decompresses to return to the original first uncompressed height 121. In some embodiments, the device and system 100 guides the user to shift their center of gravity forward to stand up. In some embodiments, the decompression of the body 101 pushes the body 101 back against the user to aid the user in moving to the standing position. Particularly, in some embodiments, applying weight and/or force to the body 101 acts to load the compression section 107 with energy which is then released as the user stands to aid the user in moving to the standing position.

In some embodiments, the body 101 comprises pushable button 111 which is first pressed to enable to body 101 to compress under weight and/or force. In some embodiments, the body 101 is locked until the button 111 is pressed. Alternatively, in some embodiments, the body 101 comprises a separately activated lock which enables the body to lock into place. Additionally, as shown within FIGS. 1A and 1B, in some embodiments the grasping section 103 comprises a handle 113 which is used with the device and system 100. In some embodiments, the grasping section 103 surrounds an exterior of the contact section 105 and slides down the contact section 105 as the body 101 of the device and system 100 compresses. Alternatively, in some embodiments, the compression section 107 is compressed between the grasping section 103 and the contact section 105 which remain static as weight and/or force is placed on the body 101. As further shown within FIGS. 1A and 1B, in some embodiments, the device and system 100 comprises a stabilizing base 115 at the contacting section 115 for stabilizing the device and system 100 during use.

As described above, the support device and system 100 aids a user as the user moves from a sitting position to a standing position and is also usable as a support as the user walks. In some embodiments, the device and system 100 guides the user to shift their center of gravity forward as the user stands. In some embodiments, the compression section 107 is able to be loaded with energy which is released to aid a user moving to the standing position. Additionally, the compression section 107 is also able to absorb bumps and shocks as the user walks and the device and system 100 is used for support when walking.

Figures 2A, 2B:
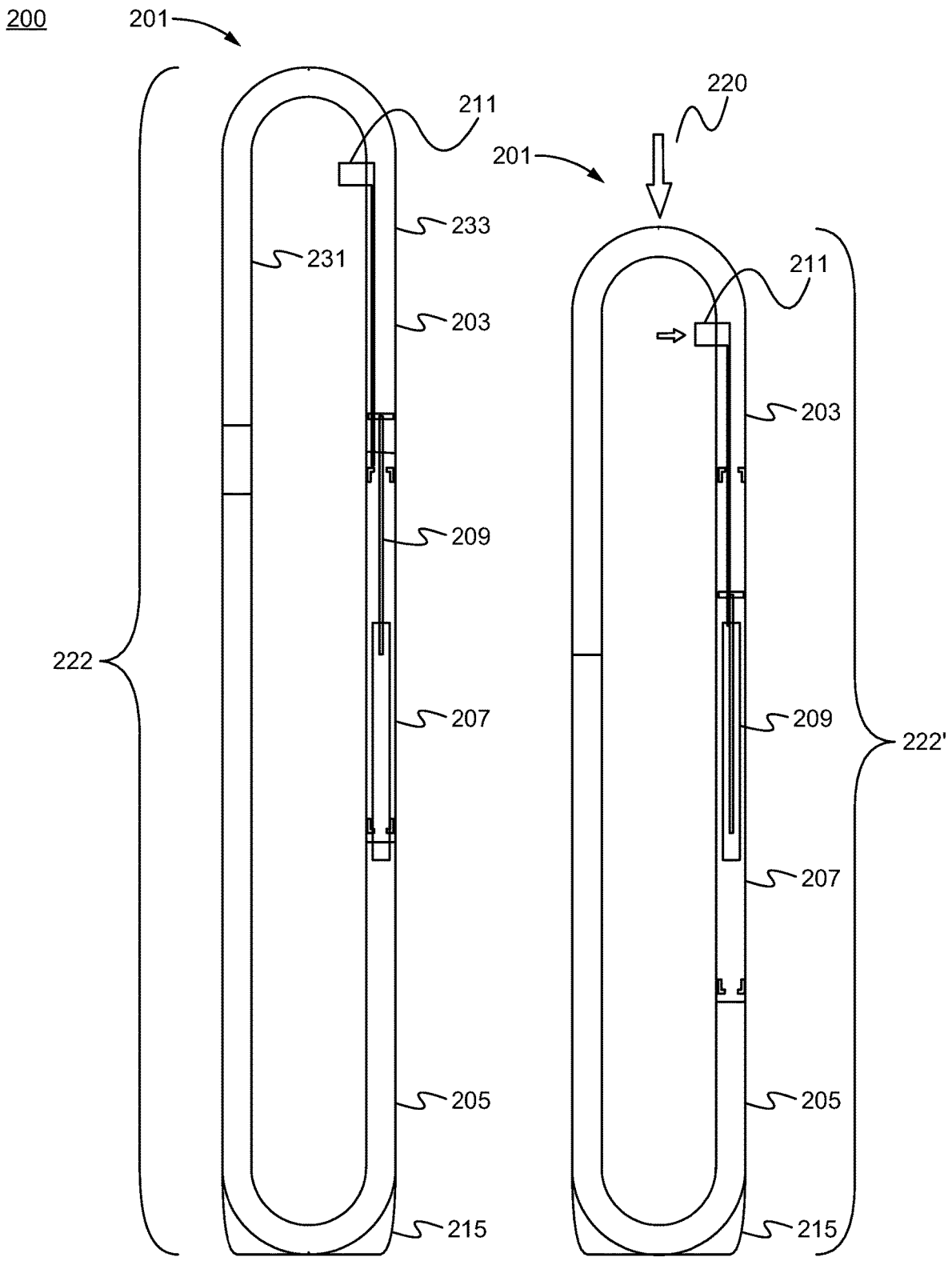
FIGS. 2A and 2B illustrate a support device and system, in accordance with some embodiments.

FIGS. 2A and 2B illustrate a support device and system in accordance with further embodiments. The support device and system 200 is similar to the device and system 100, such as described above and aids a user as the user moves from a sitting position to a standing position and is also usable as a support as the user walks.

As shown within FIGS. 2A and 2B, the supporting device and system 200 comprises a body 201 comprising a top section 203 and a bottom section 205. A compression section 207 between the first grasping section 203 and the second contacting section 205 enables the device and system 200 to compress and decompress as the user stands and walks. In some embodiments, the compression section 207 comprises one or more of a coil spring, a hydraulic shock absorber, an elastomer shock absorber and a stretchable cord within an interior 209 of the compression section 207. In some embodiments, the stretchable cord comprises a bungee cord. Particularly, the compression section 207 is able to comprise any appropriately desired compression mechanism.

Similar to the body 101, such as described above, the body 202 comprises a first uncompressed height 222. As weight and/or force is applied to the body 202, the body 202 compresses at the compression section 207 and moves to a second compressed height 222$^1$ such as shown within FIG. 2B. When moving from a sitting position to a standing position, a user is able to grasp the top section 203. As a user begins to stand and/or applies weight and/or force to the body 202, the body is compressed to the compressed height 222$^1$. In some embodiments, as the body 202 compresses it guides the user to shift their center of gravity forward to stand up. In some embodiments, the user continues to move to the standing position, the body 202 decompresses and to return to the original first uncompressed height 222. In some embodiments, the device and system 200 guides the user to shift their center of gravity forward to stand up. In some embodiments, the decompression of the body 202 pushes the body 202 back against the user to aid the user in moving to the standing position. Particularly, in some embodiments, applying weight and/or force to the body 202 acts to load the compression section 207 with energy which is then released as the user stands to aid the user in moving to the standing position.

As shown within FIGS. 2A and 2B, in some embodiments the body 201 is an oval-like or paper clip-like shape and the top section 203 comprises a first side 231 and a second side 233. In these embodiments, a user is able to use two hands to grasp the body 201 by holding onto the first side 231 with one hand and the second side 233 with the opposite hand. Then, a user is able to further stabilize themselves and apply weight and/or force to the body 202, such as described above, to move from the sitting position to the standing position.

In some embodiments, the body 202 comprises pushable button 211 which is first pressed to enable to body 202 to compress under weight and/or force. In some embodiments, the body 202 is locked until the button 211 is pressed. Alternatively, in some embodiments, the body 202 comprises a separately activated lock which enables the body to lock into place. In some embodiments, the top section 203 surrounds an exterior of the bottom section 205 and slides down the bottom section 205 as the body 202 of the device and system 200 compresses. Alternatively, in some embodiments, the compression section 207 is compressed between the top section 203 and the bottom section 205 which remain static as weight and/or force is placed on the body 202. As further shown within FIGS. 2A and 2B, in some embodiments, the device and system 200 comprises a stabilizing base 225 at the contacting section 225 for stabilizing the device and system 200 during use.

As described above, support device and system 200 aids a user as the user moves from a sitting position to a standing position and is also usable as a support as the user walks. The compression section 207 is able to be loaded with energy which is released to aid a user moving to the standing position. Additionally, the compression section 207 is also able to absorb bumps and shocks as the user walks and the device and system 200 is used for support when walking.

Figure 3:
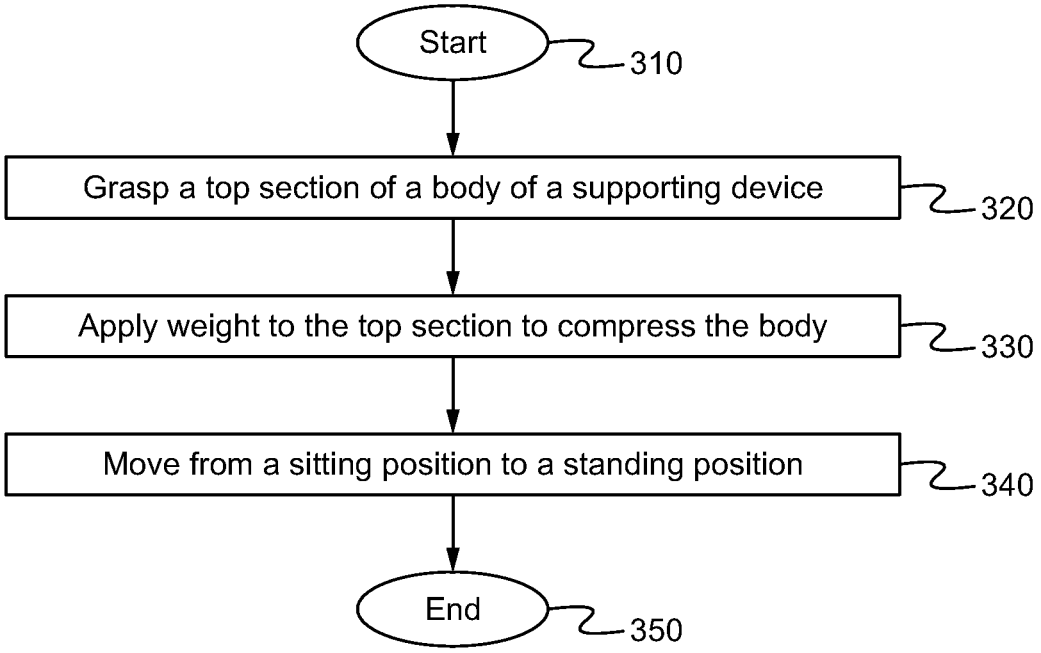
FIG. 3 illustrates a method of assisting a person moving from a sitting position to a standing position, in accordance with some embodiments.

FIG. 3 illustrates a method of assisting a person moving from a sitting position. The method begins in the step 310. In the step 320, a top section of a body of a supporting device is grasped. Then, in the step 330, weight and/or force is applied to the top section to compress the body. In the step 340, the user moves from the sitting position to the standing position. As the person moves from a sitting position to a standing position, the body decompresses upward to return to an original body height. In some embodiments, In some embodiments, as the body compresses it guides the user to shift their center of gravity forward to stand up. As described above, in some embodiments, the decompression of the body pushes the body back against the user to aid the user in moving to the standing position. Particularly, in some embodiments, applying weight and/or force to the body acts to load a compression section of the body with energy which is then released as the user stands to aid the user in moving to the standing position.

In some embodiments, the method comprises pushing a button which enables the body to compress. In some embodiments, the body is locked until the button is pushed. In some embodiments, the body compresses by one or more of a coil spring, a hydraulic shock absorber, an elastomer shock absorber and a stretchable cord. However, as described above, the body is able to compress by any appropriately desired compression mechanism. In some embodiments, after a suer stands, the supporting device is used as a walking support.

In operation, the support device and system aids a user as the user moves from a sitting position to a standing position and is also usable as a support as the user walks. A user is able to grasp and hold a top section of the device as the user stands up. As weight and/or force of the user is placed on the top section, the device compresses under the user's weight and/or force. As the user stands up, the device decompresses upward to return to its original height. As the body 202 compresses it guides the user to shift their center of gravity forward to stand up. Particularly, in some embodiments, applying weight and/or force to the body acts to load the compression section with energy which is then released as the user stands to aid the user in moving to the standing position. In this manner the device and system is able to aid the user moving from a sitting position to a standing position. Additionally, the device is then usable as a support as the user walks. When used as a walking support the compression mechanism is able to absorb bumps and shocks as the user walks. As such, the standing and walking support device, system and method of use such as described herein has many advantages.

The present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiments chosen for illustration without departing from the spirit and scope of the invention.

I claim:

1. A support device comprising:

a. a first u-shaped grasping section;

b. a second u-shaped contacting section coupled to the first grasping section and for contacting the ground;

c. a compression section between the first u-shaped grasping section and the second u-shaped contacting section, wherein the compression section enables the device to move between a first uncompressed height and a second compressed height to assist a user as the user stands and walks; and d. a single pushable button, wherein when continually pushed, the single pushable button enables the compression section of the support device to compress while keeping upward pressure on the first u-shaped grasping section and further wherein when the single pushable button is not pushed, the compression section is not able to compress.

2. The support device of claim 1, wherein the device is locked until the single button is pushed.

3. The support device of claim 1, wherein the compression section comprises one or more of a coil spring, a hydraulic shock absorber, an elastomer shock absorber and a stretchable cord.

4. The support device of claim 1, wherein the device comprises a stabilizing base at the second contacting section.

5. The support device of claim 1, wherein the first grasping section and the second contacting section comprise u-shaped tubular members.

6. The support device of claim 1, wherein the first grasping section surrounds an exterior of the second contacting section as the device compresses.

7. A support system comprising:

a. a body comprising:

i. a u-shaped top section;

ii. a u-shaped bottom section coupled to the u-shaped top section;

iii. a compression section between the u-shaped top section and the u-shaped bottom section, wherein to move from a sitting position to a standing position, a user grasps the u-shaped top section and applies weight to the u-shaped top section to compress the body to move to a compressed body height, which guides the user to shift forward, wherein then as the user moves from a sitting position to a standing position, the body decompresses to return to an original body height; and iv. consisting of a single pushable button, wherein when continually pushed, the single pushable button enables the compression section to compress while keeping upward pressure on the u-shaped top section and further wherein when the single pushable button is not pushed, the compression section is not able to compress.

8. The support system of claim 7, wherein the body is locked until the single button is pushed.

9. The support system of claim 7, wherein the compression section comprises one or more of a coil spring, a hydraulic shock absorber, an elastomer shock absorber and a stretchable cord.

10. The support system of claim 7, wherein the device comprises a stabilizing base at the second contacting section.

11. The support system of claim 7, wherein the top section and the bottom section comprise u-shaped tubular members.

12. The support system of claim 7, wherein the first top section surrounds an exterior of the bottom section as the device compresses.

13. A method of assisting a person moving from a sitting position to a standing position comprising:

a. grasping a u-shaped top section of a body of a supporting device;

b. pushing only a single button to enable the support device to compress while keeping upward pressure on the u-shaped top section, wherein when the single button is not continually pushed, the support device is not able to compress; and c. applying weight to the top section to compress the top section towards a U-shaped bottom section of the body to move to a compressed body height, wherein then as the person moves from a sitting position to a standing position, the body decompresses to return to an original body height.

14. The method of claim 13, wherein the decompression of the body aids the person in moving to a standing position.

15. The method of claim 13, wherein the body is locked until the single button is pushed.

16. The method of claim 13, wherein the body compresses by one or more of a coil spring, a hydraulic shock absorber, an elastomer shock absorber and a stretchable cord.

17. The method of claim 13, comprising, after standing using the supporting device as a walking support.

18. A support device comprising:

a. a first u-shaped tubular section comprising a handle for holding the support device;

b. a second u-shaped tubular section coupled to the first tubular section and for contacting the ground;

c. a compression section between the first u-shaped tubular section and the second u-shaped tubular section, wherein the compression section enables the device to move between a first uncompressed height and a second compressed height to assist a user as the user stands and walks; and d. a single pushable button, wherein when continually pushed, the single pushable button enables the compression section of the support device to compress while keeping upward pressure on the first u-shaped tubular section and further wherein the single pushable button is not pushed, the compression section is not able to compress.

19. The support device of claim 18, wherein the first tubular section surrounds an exterior of the second tubular section as the device compresses.

20. A support device comprising:

a. a top section comprising a first u-shaped tubular member;

b. a bottom section comprising a second u-shaped tubular member coupled to the first u-shaped tubular member, wherein together the top section and the bottom section form an oval-like body;

c. a compression section between the first u-shaped tubular member and the second u-shaped tubular member, wherein the compression section enables the device to compress and decompress in order to assist a user as the user stands and walks; and d. a single pushable button, wherein when continually pushed, the single pushable button enables the compression section of the support device to compress while keeping upward pressure on the first u-shaped tubular member and further wherein when the single pushable button is not pushed, the compression section is not able to compress.

21. The support device of claim 20, wherein the first u-shaped tubular member surrounds an exterior of the second u-shaped tubular member as the device compresses.

* * * * *